United States Patent [19]

Hyun

[11] 4,238,4

[45] Dec. 9, 19

[54] PROCESS FOR PRODUCING SELF-CRIMPING POLYAMIDE YARNS

[75] Inventor: Jae C. Hyun, Pensacola, Fla.

[73] Assignee: Monsanto Company, St. Louis, Mo.

[21] Appl. No.: 839,868

[22] Filed: Oct. 6, 1977

[51] Int. Cl.[3] ..... D01D 5/22

[52] U.S. Cl. ..... 264/168; 264/176 F; 264/177 F

[58] Field of Search ..... 264/210 Z, 168; 428/369, 371, 399, 397

[56] References Cited

U.S. PATENT DOCUMENTS 2,957,747 10/1960 Bowling ..... 264/210 Z

FOREIGN PATENT DOCUMENTS 48-28012 8/1973 Japan ..... 264/210 Z

OTHER PUBLICATIONS

"The Melting of and Crystallization of Copolymers of Nylon 66 and 610 with 6T", Harvey et al., Polym vol. 12, pp. 711–716, 1971.

*Primary Examiner*—Jay H. Woo

*Attorney, Agent, or Firm*—John W. Whisler

[57] ABSTRACT

A melt spinning process for producing nominal 20 c nier per filament polyamide yarn having a latent bulk at least 18% is provided. The process employs polyhe amethylene adipamide modified to contain from 1 to mole % of recurring units of the formula

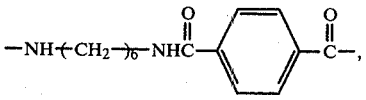

whereby wind-up speeds ranging from 1830 to 45 meters per minute and higher are attainable. The resu ing yarn has a usable bulk, when developed, for carp yarn applications without further texturing of the yar

9 Claims, No Drawings

PROCESS FOR PRODUCING SELF-CRIMPING POLYAMIDE YARNS

BACKGROUND OF THE INVENTION

A. Field of the Invention

This invention relates to a melt spinning process for producing a multifilament yarn of a modified nylon 66 (polyhexamethylene adipamide) having a denier per filament of at least 18, whereby a latent bulk of at least 18% is imparted to the yarn without the application of any special bulking equipment or steps, that is, the yarn is "self-crimping".

D. Description of the Prior Art

In conventional spin-draw processes for producing a nylon 66 multifilament yarn, molten fiber-forming nylon 66 is extruded through spinneret orifices at a given rate to form molten streams. The molten streams cool and elongate in a cooling zone as they move away from the spinneret. The cooling is normally assisted by a transverse stream of flowing air in a quenching chamber, commonly referred to as a chimney, positioned immediately below the spinneret through which the molten streams pass. The molten streams solidify in the lower region of the chimney to form filaments. Conventionally, the filaments are withdrawn from the cooling zone by passing the filaments around at least one rotatable roll, such as a feed roll (driven at a given peripheral speed) and its associated separator roll. The filaments make at least a partial wrap and preferably several wraps around the roll(s) to assure that substantially no slippage of the filaments occur on the roll(s). The extrusion rate and the peripheral speed of the rotatable roll(s) (e.g. feed roll and its associated separator roll) are correlated to provide a yarn having a given denier per filament (dpf). From the feed roll the filaments are normally wound onto a take-up bobbin. The peripheral speed of the take-up bobbin is usually slightly higher than that of the feed roll so as to facilitate winding of the filaments on the bobbin. In practice, a spin finish is usually applied to the filaments just prior to the feed roll, such as, by passing the filaments into contact with a rotatable finish roll which is partially immersed in a finish contained within a resevoir. The filaments converge on the finish roll or in the absence of such on the feed roll to provide a yarn.

It is generally recognized that for carpet yarn applications a yarn bulk of at least about 18% (as hereinafter defined) is required. Applicants have found that when 10 dpf nylon 66 yarn is prepared by the foregoing spin-draw process utilizing a feed roll peripheral speed of about 4800 yards per minute (ypm), a latent bulk of about 18% is imparted to the yarn at a constant dpf, yarn bulk normally increases feed roll peripheral speeds. Unfortunately, in preparing 20 dpf yarns, the peripheral speed of the feed roll is limited to a maximum speed of about 2400 ypm, at which speed the maximum latent bulk imparted to the yarn is only about 15%. In the case of 20 dpf yarn, when the extrusion rate and feed roll peripheral speed are increased sufficiently to impart a latent bulk of 18% or higher to the yarn the filaments stick to one another in the chimney and/or at their point of convergence (e.g. finish roll). Such sticking occurs when the filaments are at a temperature above their stick temperature and ultimately leads to broken and/or damaged filaments and yarn of inferior or unacceptable quality. It will be appreciated that increasing the dpf also results in an increase in the surface area and crosssectional area of the filaments. Consequently more co ing is needed to reduce the temperature of the filame to a temperature below their stick temperature. At same time, as the extrusion rate and peripheral speed the feed roll are increased, the residence time of filament in the quenching chamber is reduced.

An object of the present invention is to provid means for imparting a latent bulk of at least 18% large dpf nylon 66 yarns utilizing the spin-draw proc hereinabove described.

Another object of the invention is to produce yarn described in the preceeding paragraph with utilizing additional equipment and/or processing ste Other objects and advantages of the invention v become apparent from the following detailed descr tion thereof.

SUMMARY OF THE INVENTION

In accordance with the foregoing objects, it has be discovered that the hereinabove-described spin-dr process can be employed to produce large dpf (≧ multi-filament yarn having a latent (i.e. potential) b of at least 18% by (i) modifying the nylon 66 to cont as an integral part of its polymer chain from about 1 about 10 mole % of recurring units of the formula

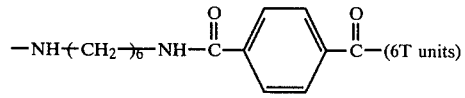

and (ii) operating the process so that the periphe speed of the rotatable roll(s) e.g. feed roll and its assc ated separator roll) is at least 2000 yards (1828.8 mete per minute and correlated with the extrusion rate provide a yarn having a dpf of at least 18. The resulti yarn may be treated in a conventional manner to velop the latent bulk, such as, by heating the yarn wh relaxed to a temperature between about 90° C. a about 220° C. with steam or dry heat. The resulti textured yarn has a helical crimp and a bulk of at le 18% as determined by the formula $$\% \text{ Bulk} = \frac{L_1 - L_2}{L_1} \times 100$$

where $L_1$ is a given length of yarn before developm of the latent crimp and $L_2$ is the length of the same y after the latent crimp has been developed by subjecti the length of yarn ($L_1$) to 180° C. dry heat for f minutes followed by cooling of the yarn at ambi temperature for one minute. Then, the length of yarn is again measured ($L_2$), stressed at 0.0009 g (grams per denier) load, 30 seconds after cooling.

More specifically, the process of this invention co prises:

(a) extruding at a given extrusion rate through n round spinneret orifices a fiber-forming polyam consisting essentially of randomly recurring u of the formula

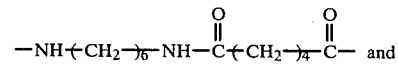

and

-continued

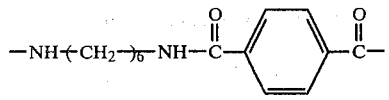

(ii)

wherein the mole ratio of (i) units to (ii) units is in the range of from about 90:10 to about 99:1, to form molten streams;

(b) differentially quenching said molten streams by exposing one side thereof to transversely flowing air in a cooling zone to form filaments; and (c) withdrawing said filaments from said cooling zone by passing said filaments around at least one rotatable with at least a partial wrap; wherein the peripheral speed of said at least one rotatable roll is at least 2000 yards (1828.8 meters) per minute and is correlated with said extrusion rate to provide a multi-filament yarn having a denier per filament of at least 18.

The process is a self-crimping process in that no spe- al crimping apparatus and/or crimping steps are uti- :ed.

)ETAIL DESCRIPTION OF THE INVENTION

66/6T polymers useful in carrying out the process of is invention can be prepared by simply adding a suit- ıle amount of an appropriate monomer to a conven- ɔnal batch or continuous process for producing nylon ). Thus, in the conventional process for preparing ylon 66 where an aqueous solution of nylon 66 salt (i.e. ɔlyhexamethylenediammonium adipate) is heated with e removal of water under conditions of controlled ne, temperature and pressure to provide molten nylon ) of a desired fiber-forming molecular weight, a suffi- ɜnt amount of nylon 6T salt (i.e. polyhexame- ylenediammonium terephthalate) is simply added itially to the aqueous solution to provide a modified ylon 66 (nylon 66/6T). composed of 66 and 6T units ithin the foregoing specified mole ratio range.

The filaments are preferably withdrawn from the ɔoling zone by means of a driven feed roll and its sociated separator roll around which the filaments ake several wraps. The peripheral speed of the feed ll may range from about 2000 ypm to 5000 ypm and gher. At speeds less than about 2000 ypm, the bulk vel of the resulting yarn is less than about 18% and, erefore, such speeds are not satisfactory producing xtured yarns for carpet yarn applications.

In general, the maximum feed roll peripheral speed hich can be utilized with the process without causing cking of the filaments increases with increasing 6T ole % of the nylon 66/6T. On the other hand, the aximum feed roll peripheral speed which can be uti- :ed without stretching (drawing) the filaments in the ımney beyond their breaking elongation value (i.e. ), decreasing with increasing 6T content of the nylon /6T. It has been found that in practicing the process this invention the maximum feed roll peripheral eed which can be utilized without encountering stick- g of the filaments and without exceeding their $E_b$ ılues exists when the 6T content of the nylon 66/6T is ɔut 5%. With a 20 dpf yarn this maximum peripheral eed is about 5400 ypm. Accordingly, the maximum able feed roll peripheral speed increases from about )00 ypm with increasing 6T content to a maximum value at about 5 mole % 6T and thereafter decreases with increasing 6T content.

In order to impart latent bulk to the yarn, the filaments must be of a non-round cross-section, such as, of a triskelion or trilobal cross-section. In general, the filaments of yarns prepared by the process of this invention have a modification ratio (MR) greater than 1.2 and less than 4.0 and normally between about 1.5 and 3.2. The term modification ratio as used herein are defined in accordance with conventional terminology, such as in U.S. Pat. No. 2,939,201.

Quenching of the freshly extruded molten streams is accomplished by exposing one side thereof to transversely flowing air, conventionally, within a chimney. The air is usually at ambient temperature and is at a velocity such that turbulence of the filaments does not occur. The molten streams solidify in the lower region of the chimney to provide filaments. Reducing the temperature of the cooling air has been found to have little effect on the cooling of the filaments since residence time of the filaments in contact with the cooling air is extremely short.

The molten streams and then the filaments are typically withdrawn from the spinneret by means of a driven roll (feed roll) and its associated separator roll. The filaments are passed around these rolls with a sufficient number of wraps to assure that the filaments do not slip on the rolls. The extrusion rate and peripheral speed of the feed roll are correlated to provide drawn yarn of a desired dpf. The process is ideally suited for providing carpet yarn of nominal 20 dpf (18–22 dpf) although larger dpf can be also produced, for example, 30 dpf yarn. In general, other conditions being held constant, yarn bulk increases with increasing dpf.

The yarn is passed from the feed roll to a take-up bobbin or other suitable device for collecting the yarn such as a piddler. Normally, the take-up bobbin is operated at a peripheral speed slightly higher than that of the feed roll so as to impart a slight tension to the yarn to facilitate packaging. However, if desired, the yarn may be subjected to an interlacing device (e.g. fluid jet) just prior to being collected to increase the coherency thereof. In this case, of course, the take-up bobbin would be operated at a peripheral speed less than that of the feed roll.

In normal operations, a finish (spin finish) is applied to the filaments just prior to the feed roll by means of, for example, a transfer roll, that is, a rotatable roll partially immersed in a finish over which the filaments pass. When a finish roll is employed, the filaments are converged on the roll. In the absence of such a roll, the filaments converge on the feed roll. A spin finish is conventionally applied to the filaments to facilitate packaging of the yarn.

It will be apparent to those skilled in the art that the processing conditions employed in carrying out the process of the invention may be widely varied without department from the spirit or scope of the invention.

To further illustrate the invention the following example is given but are not intended to in any way limit the invention to the particular embodiments described therein.

EXAMPLE 20 dpf drawn yarns each composed of eight filaments of triskelion cross-section were prepared from nylon 66 (control) and from nylon 66/6T in which the 6T content was varied from 2.5 mole % to 10 mole % as specified in the Table. Also, a 10 dpf −8 filament drawn nylon 66 yarn of triskelion cross-section was prepared.

In preparing each of the yarns, molten polymer of the composition specified in the Table was extruded through the capillaries (triskelion cross-section) of a 8-hole spinneret into a conventional melt spinning chimney having a cross flow of cooling air with a delivery of 300 cfm (8495 lpm) at a temperature of 18° C. The chimney was positioned immediately below the spinneret and measured 8 feet (2.4 m) in length. The filaments solidified in the chimney and were withdrawn from the chimney and passed into contact with a finish roll positioned about 12 feet (3.7 m) from the lower face of the spinneret. The filaments converged on the finish roll to form a yarn which was then passed around a feed roll and its associated separator roll with several wraps and finally collected on a take-up bobbin. The peripheral speed of the feed roll and take-up bobbin were substantially the same and is specified in Table I as the wind-up speed. Each yarn was produced using the maximum possible take-up speed, that is, the maximum take-up speed at which the process could be operated without causing the filaments to stick to one another when converged on the finish roll and/or to break by being stretched beyond their $E_b$ value. The % bulk of each yarn was determined in the manner hereinbefore described and is given in the Table.

TABLE

| Yarn Polymer Mole % 66 | Composition Mole % 6T | Wind-up Speed ypm(mpm) | % Bulk | MR | dpf |
|---|---|---|---|---|---|
| 100 (control) | 0 | 2400 | 15 | 3.90 | 20 |
| 100 (control) | 0 | 4800 | 18.3 | 3.75 | 10 |
| 97.5 | 2.5 | 5100 | 20.3 | 3.02 | 20 |
| 95 | 5 | 5400 | 22.3 | 3.11 | 20 |
| 92.5 | 7.5 | 5000 | 22.9 | 3.03 | 20 |
| 90 | 10 | 4200 | 19.1 | 3.15 | 20 |

The results in the Table illustrate that the process of this invention provides 20 dpf yarns having a latent bulk in excess of 18% at relatively high speeds (5400 ypm). In contrast, 20 dpf nylon 66 yarns cannot be processed at speeds above about 2400 ypm and, when processed at such speeds, the resulting yarn does not contain satisfactory latent bulk for carpet yarn applications without being subjected to additional texturing operations.

I claim:

1. A melt spinning process for producing a multifilament polyamide yarn having at latent bulk of at least 18%, comprising (a) extruding at a given extrusion rate through sp neret orifices of trilobal or triskellion cross-sect a fiber-forming polyamide consisting essentially randomly recurring units of the formula

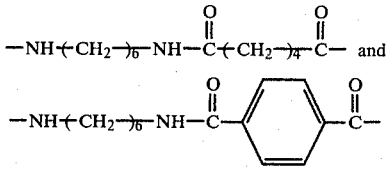

wherein the mole ratio of (i) units to (ii) units is the range of from about 90:10 to about 99:1, to fo a molten stream;

(b) differentially quenching said molten streams exposing one side thereof to transversely flow air in a cooling zone to provide filaments (c) withdrawing said filaments from said cooling zo by passing said filaments around at least one rot able roll with a least a partial wrap; and (d) collecting said filaments under tension on a ta up bobbin;

wherein the peripheral speed of said rotatable roll(s at least 2000 yards (1828.8 meters) per minute and correlated with said extrusion rate to provide a dra yarn having a denier per filament of at least 18 a wherein said filaments have a modification ratio grea than 1.2 and less than 4.0.

2. The process of claim 1 wherein said at least c rotatable roll consists of a driven roll and an associa separator roll around which the filaments make a plu ity of wraps.

3. The process of claim 2 wherein the mole ratio of units to (ii) units is between about 92.5:7.5 and ab 97.5:2.5.

4. The process of claim 3 wherein said periphe speed is at least 3000 yards (2743.2 meters) per minu 5. The process of claim 4 wherein the resulting y has a denier per filament of about 20.

6. The process of claim 2 wherein the mole ratio of units to (ii) units is about 95:5.

7. The process of claim 6 wherein said periphe speed is at least 5000 yards (4572 meters) per minut 8. The process of claim 7 wherein the resulting y has a denier per filament of about 20.

9. The process of claim 8 wherein said filaments withdrawn from said driven roll by means of a take- device.

* * * * *